106-90 AU 115 EX
XR 3,953,953

United States Patent [19]

Marsden

[11] 3,953,953

[45] May 4, 1976

[54] CONCRETE REINFORCING ELEMENTS AND REINFORCED COMPOSITE INCORPORATING SAME

[75] Inventor: Winston Anthony Marsden, Abbotsford, Australia

[73] Assignee: Australian Wire Industries Proprietary Limited, Australia

[22] Filed: Nov. 27, 1973

[21] Appl. No.: 419,446

[30] Foreign Application Priority Data

Nov. 28, 1972 Australia ..... 1402/72

[52] U.S. Cl. ..... 52/659; 52/735

[51] Int. Cl.[2] ..... E04B 1/00

[58] Field of Search ..... 52/659, 737, 720, 733, 52/735, 739, 663

[56] References Cited

UNITED STATES PATENTS

| | | | |
|---|---|---|---|
| 715,433 | 12/1902 | Streator | 52/659 |
| 1,757,694 | 5/1930 | Weichold | 52/659 |
| 1,976,832 | 10/1934 | Brown | 52/659 |
| 3,384,395 | 5/1968 | Brandestini | 52/720 X |
| 3,684,474 | 8/1972 | Chisholm | 52/659 X |

FOREIGN PATENTS OR APPLICATIONS

| | | | |
|---|---|---|---|
| 252,975 | 6/1926 | United Kingdom | 52/659 |

*Primary Examiner*—Ernest R. Purser
*Assistant Examiner*—Carl D. Friedman
*Attorney, Agent, or Firm*—Cushman, Darby & Cushman

[57] ABSTRACT

This specification discloses a method of and apparatus for forming concrete reinforcing elements having enlarged ends and also discloses a reinforced composite incorporating such elements. In one embodiment the enlarged ends are formed by folding the edges of a strip of sheet metal onto itself while in another form the enlarged ends are formed by edge rolling a strip. In both cases the reinforcing element is formed by transversely shearing the strip after its edge has been modified. The reinforcing elements as described above are shown to have a greater pull-out resistance than plain elements.

4 Claims, 14 Drawing Figures

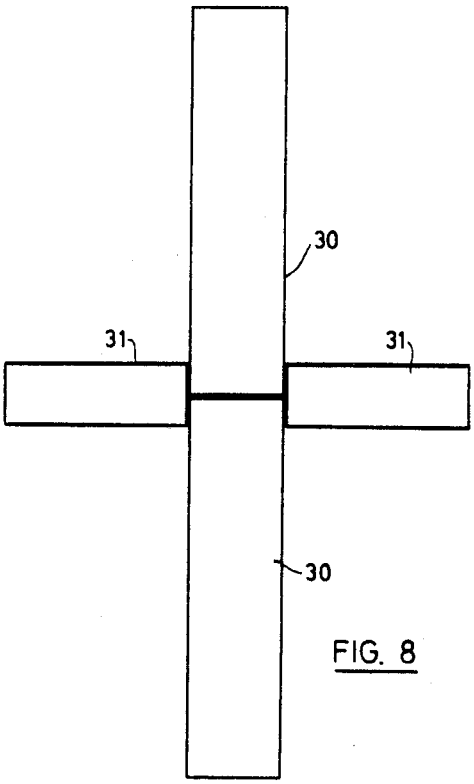
FIG. 8
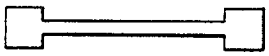
FIG. 10
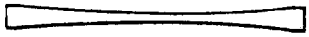
FIG. 11
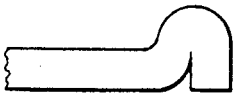
FIG. 12
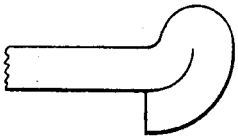
FIG. 13
FIG. 9
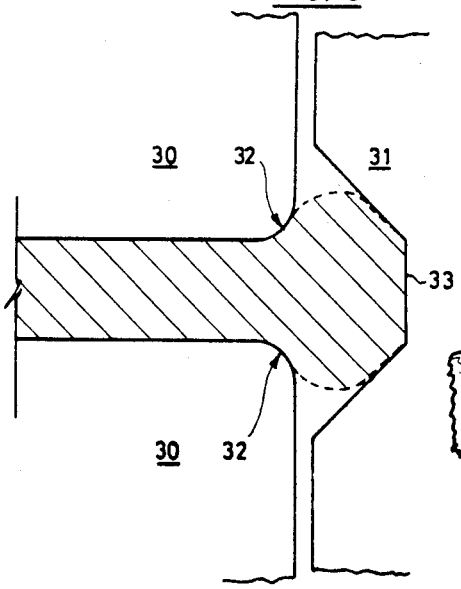
FIG. 9a
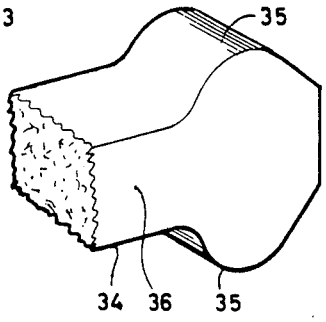

CONCRETE REINFORCING ELEMENTS AND REINFORCED COMPOSITE INCORPORATING SAME

FIELD OF THE INVENTION

This invention relates to reinforcing elements for concrete and other castable materials such as plastics and ceramics, and to a process for manufacturing such reinforcing elements. The invention also relates to a reinforced composite incorporating such reinforcing elements.

BACKGROUND OF THE INVENTION

It is known to incorporate short lengths of steel wire in concrete to improve its properties. Such a reinforced composite is described in the specification of Australian Pat. No. 290,468. A related reinforced composite comprising a castable matrix mass, such as concrete, incorporating discontinuous reinforcing filaments having a non-round cross-section with a width and thickness ratio of not greater than five is disclosed in U.S. Pat. No. 3,650,785.

In each of the above concrete-steel fibre composites, the increase in strength has been limited by the poor mechanical and chemical bond between the steel fibres and the cement matrix. The steel fibres tend to pull out of the matrix long before the fibres reach their ultimate strength.

Attempts have been made to overcome the problem but in each case the modification has been impractical or the bond strength increased only marginally. One modification involved the use of longer steel fibres but such were found too difficult to handle and mix in the matrix. Similarly, the fibres have been chemically treated, coated or crimped in an attempt to increase bond strength but with little success.

German patent publication No. 2,042,881 suggests that the wire ends be bent or shaped, but this tends to reduce mixability and reduces the effective fibre length.

It is the primary object of the invention to provide an improved form of reinforcing element which is formed to improve the locking effect between the element and the matrix it reinforces.

The invention provides, in a first aspect, a reinforcing element for materials such as concrete, mortar, glass, stabilised materials, plastics or ceramics, comprising a discontinuous filament or fibre or reinforcing material having end portions which are larger in cross-section than smallest cross-section of the shank of the filament or fibre.

Preferably, the end portions are larger in both the longitudinal and transverse planar cross-sections thereof.

The interfacial shear stresses in discontinuous filaments or fibres incorporated in a low strength brittle matrix are maximum at the fibre ends. By enlarging the end of the filament or fibre, especially in both cross-sections, the locking effect at the ends is improved due to the enlargement of the ends relative to the shank and accordingly the reinforcing effect of the fibre should be increased using more or all of its available tensile strength.

It is preferred that the end portions of the fibre be enlarged by deformation to suitably shape the end and for this reason the fibre is preferably made from a metal, plastic or other material capable of being permanently deformed or shaped.

Where the material being reinforced is concrete or mortar, the fibres are preferably of steel, although other metals or metallic alloys having the required high tensile strengths, e.g., above 30,000 psi, may be used if desired.

The fibres may have any desired cross-sectional configuration and are preferably in the form of short lengths of wire-like material with the shank thereof plain and of substantially uniform unvarying cross-section. The gauge tensile strength and configuration of the fibre shank is selected according to the desired performance and may include gauges and configurations as disclosed in the prior art referred to hereinabove.

The low strength brittle matrix material may be any of the conventional castable curable or hardenable matrix material but preferably is a cementitious castable matrix mass such as concrete or plain mortar. Most preferably the cementitious matrix mass is based on Portland cement.

Suitable cementitious compositions are disclosed in Kirk-Othmer, *Encyclopedia of Chemical Technology*, Second Edition, Volume 4, pages 684–710 (1964), the disclosure of which is hereby incorporated by reference.

The reinforcing fibres, which are discontinuous, may be chosen from a wide variety of materials, including reinforcing glass fibres, reinforcing nylon fibres, reinforcing titanium fibres, reinforcing tungsten fibres, reinforcing copper fibres, reinforcing lead fibres, reinforcing steel fibres and reinforcing aluminum fibres. Of course, alloys of the above-mentioned metals may also be utilized if desired.

The reinforced composite structure of the present invention is made by mixing the reinforcing fibres in the castable matrix. It is preferable to uniformly distribute the fibres throughout the matrix, although some fibre agglomeration can be tolerated. Normally, the reinforcing fibres are used in an amount of from ½ to 5% by absolute volume, preferably about 1 – 2% by absolute volume. In the case of Portland cement, concrete or mortar matrixes and steel reinforcing fibres, the steel fibres will be used in an amount of from about 3 – 6% by weight of the total composition.

The castable matrix is then cured or hardened under appropriate conditions, depending upon the nature of the matrix material. A chemical hardener or curing agent may be used in the case of thermosetting polymers. For cementitious products, the normal cure will be a simple time cure (i.e., 1 – 15 days or so) at ambient conditions, or even at elevated temperatures, normally in the presence of moisture.

In a second aspect of the invention, there is provided a method of forming reinforcing fibres of metal or other material capable of being permanently deformed or shaped comprising the steps of passing a narrow strip of said material through a roll forming operation adapted to enlarge edges of the strip and then shearing the strip transversely to form a fibre of the desired width having end enlargements.

Many different roll forming operations may be performed, such as folding or otherwise deforming the edge of the strip or reducing the cross-sectional area of the central portion of the strip to enlarge the edges relative to the central portion. These operations will be described in more detail below.

A preferred method of forming reinforcing fibres comprises forming a plurality of strips simultaneously before the roll forming operation by longitudinally slitting a wider strip. The roll forming and shearing operations are then carried out on the plurality of narrow strips with the strips running in parallel.

A single shearing device may be used to shear said plurality of formed strips simultaneously and preferably comprises a multi-toothed rotary cutter running with a slight clearance against a fixed cutter.

The invention also provides an apparatus for performing the above methods.

DESCRIPTION OF THE PREFERRED EMBODIMENTS

In the drawings:

FIG. 2 shows the steps in a simple method of enlarging the edges of a strip prior to forming the fibre of FIG. 1; wherein

FIG. 8 is a schematic representation of an apparatus for achieving the edge enlargements of FIGS. 6 and 7;

FIG. 9 is an enlarged fragmentary view of the roller profiles used to achieve the edge enlargement;

FIG. 9A is an enlarged view of one end of a reinforcing fibre produced by shearing a strip having the edge enlargement shown in FIG. 6, and FIGS. 10 to 13 are representations of alternative forms of edge enlargements.

Figure 1:
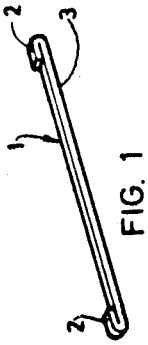
FIG. 1 is a perspective view of a reinforcing fibre embodying the invention.

FIG. 1 shows one form of steel reinforcing fibre 1 which has enlarged ends defined by the end portions 2 of the fibre 1 being folded onto its shank 3. The shank 3 is plain and of uniform unvarying cross-section from about 0.005 to 0.030 inch thick, about 0.010 to 0.060 inch wide and from about 0.5 to 2 inches or longer in length. Each fold 2 may be from about two to four times the thickness of the fibre 1, preferably from 0.020 to 0.050 inch. The dimension recited here are merely exemplary since they must be selected in accordance with the fibre material, the material to be reinforced thereby and the performance desired.

The fibre shown in FIG. 1 is made from a narrow strip of steel that has its edges folded over onto itself. The steps in one simple method of edge folding are shown in FIG. 2. A narrow strip as shown view A is fed into a forming roll to turn the edges of the strip at right angles as shown in view B. The strip then enters a further set of forming rolls that turns the turned edge further inwardly through about 45° as shown in view C. The turned edges are then flattened by a further set of forming roll as in view D.

Figure 3:
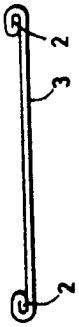
FIG. 3 is a side elevation of an alternative form of fibre having a double-folded enlarged end.

A strip with double folded edges as shown in FIG. 3 may be produced by repeating the above steps on the strip shown in view D.

After the edge-folding operation, the strip is fed to an apparatus for transversely shearing the strip into fibres 1. If a plurality of strips are used, the strips can be separated for individual shearing operations. It is also possible to shear the plurality of strips simultaneously, and in that instance the most suitable shearing device is a multi-toothed rotary cutter running with a slight clearance against a fixed cutter or anvil. However, other types of cutters, including other types of rotary cutters, are suitable for use in forming the fibres of the present invention.

The above described simple method of edge folding is satisfactory for individually fed single strips but since it requires horizontally oriented rollers for the edge turning operations, it is not satisfactory for edge folding a plurality of narrow strips slit from a wide strip and running in side by side relationship during the roll forming and shearing operations.

Figure 4:
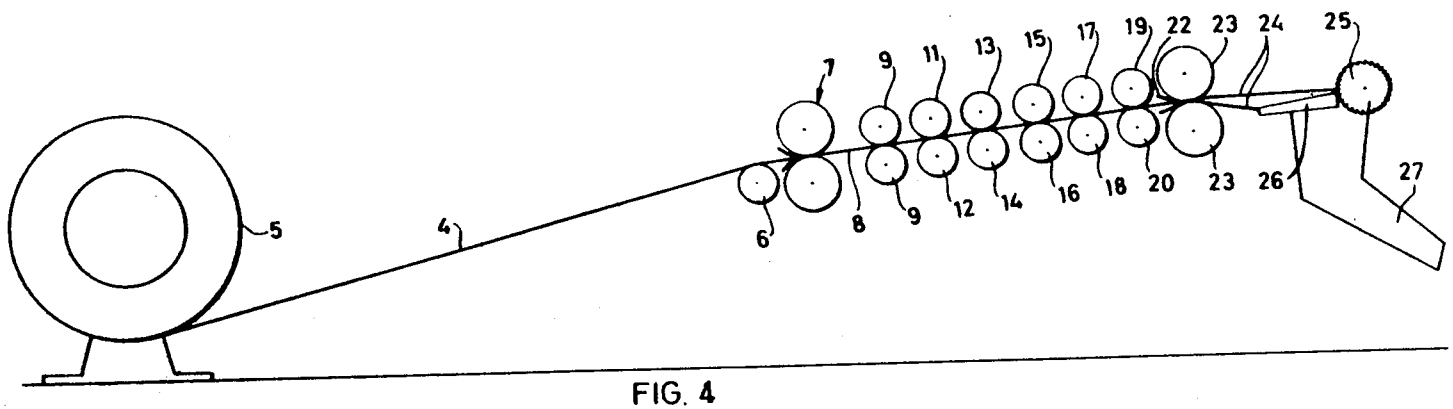
FIG. 4 is a schematic diagram of an apparatus for forming fibres from a wide strip.
Figure 5:
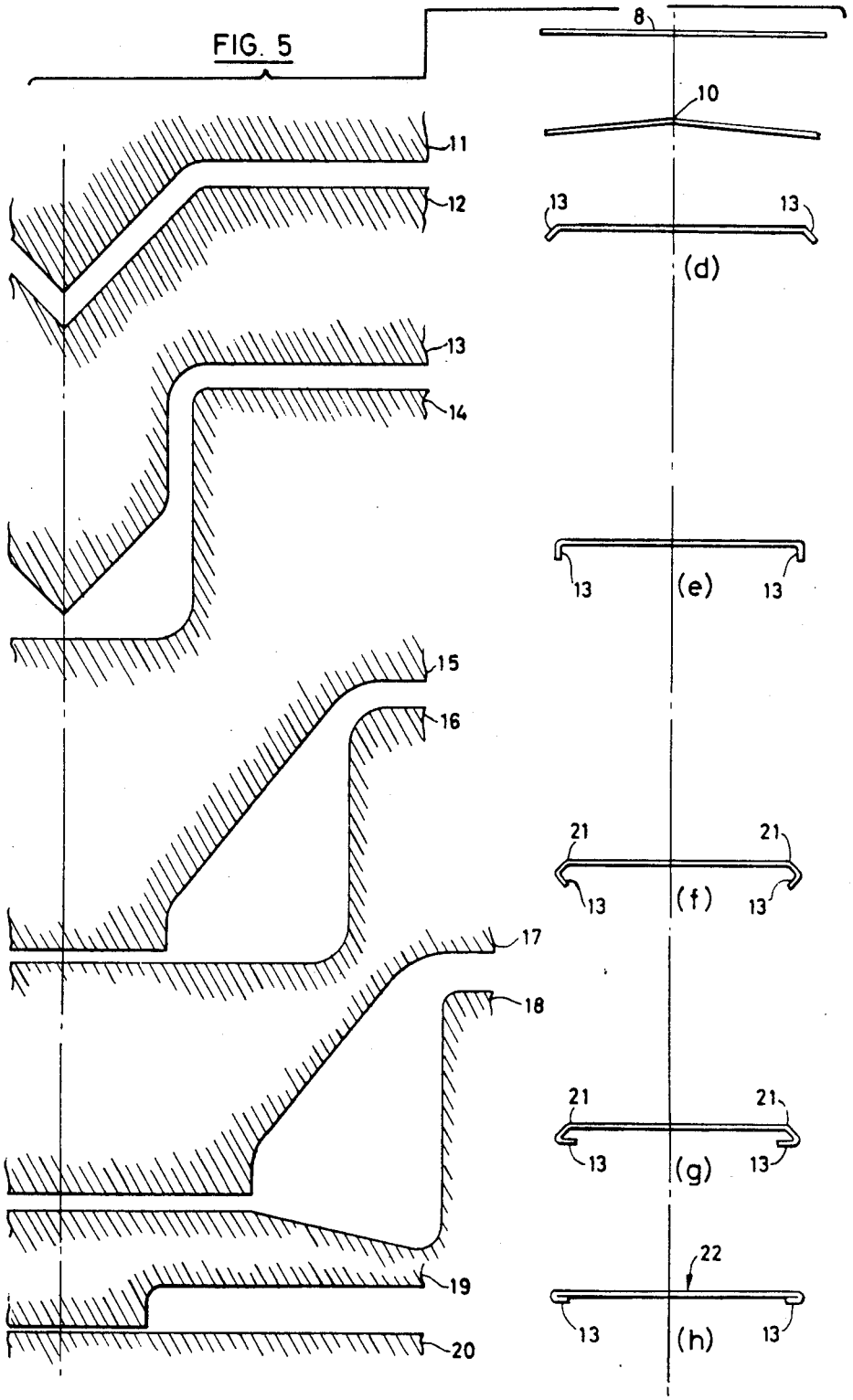
FIG. 5 shows the steps in the edge enlarging method performed by the apparatus of FIG. 4 together with schematic representations of the preferred roll forming profiles used.

An apparatus for performing edge roll forming operations on several narrow strips slit longitudinally from a wide supply strip is shown schematically in FIGS. 4 and 5. The supply strip 4 is drawn from a coil 5 suitably mounted on a pay off stand. The strip 4 passes over a guide roll 6 and through a strip slitter 7 comprising a plurality of slitting rolls that slit the strip 4 into a plurality of narrow strips 8 of the desired width (s). The construction and mode of operation of the strip slitter 7 does not form part of this invention and any conventional slitter, such as described in the copending application referred to above, may be used.

Each narrow strip 8 then passes through a roll 9 formed with a profile that imparts a false bend 10 to each strip 8, as shown in FIG. 5. The reason for this is to space the adjacent edges of the narrow strips 8 sufficiently to allow the positioning of a positive guide means (not shown) for guiding the strips 8 into the first roll forming stage. A false bend sufficient to space adjacent strip edges by between 0.015 to 0.020 inch would seem to be satisfactory.

The first roll forming stage (d) comprises upper and lower rollers 11 and 12 each having a profile that imparts a 45° bend to the edge portions 13 of each strip 8 and flattens the false bend 10 therein. (See FIG. 5). The figure shows part of the profile of the rolls 11 and 12 suitable for achieving this roll forming operation at one edge of the strip. The second to fifth roll forming stages (*e* to *h*) are also achieved by profiled rolls 13 and 14, 15 and 16, 17 and 18 and 19 and 20 respectively and the relevant profile portions of these rolls are also shown in FIG. 5.

In the second roll forming stage *e*, the edge portions 13 are turned through a further 45° to 90°. The third stage *f* forms a 45° bend 21 in the strip inwardly of the edge portion 13 while the fourth stage *g* folds the portions 13 through a further 45°. The fifth stage *h* flattens the bend 21 and places the portion 13 in intimate contact with the strip surface. The completely edge folded strip 22 is then in the same condition as in stage *d* of FIG. 2.

The plurality of strips 22 are fed by feed rolls 23 between guide plates 24 into a rotary cutter 25 that runs with a slight clearance against a fixed cutter or anvil 26 to shear the strips into reinforcing fibres of the desired width. A chute 27 collects the fibres as they are formed.

It will be evident that the single strip and multiple strip methods of manufacturing reinforcing fibres described above not only result in an enlarged end fibre but achieve this in a particularly novel way. While the single strip method would not be adequate for high volume work it may be possible to utilize this shorter method by separating the slit strips in a direction transverse to their direction of movement and passing each strip through a separate three step roll forming operation, followed by a separate or common shearing operation. If desired, the edges of the strip may be folded onto opposite surfaces of the strip.

Figure 6:
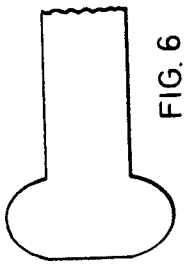
FIGS. 6 and 7 are fragmentary side elevations of two alternative forms of strip edge enlargement.
Figure 7:
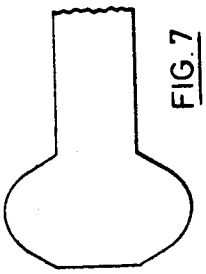
Figure 2A:
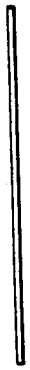
FIG. 2A shows a narrow strip.
Figure 2B:
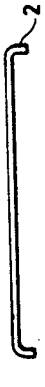
FIG. 2B shows the edges of the strip bent at substantially right angles.
Figure 2C:
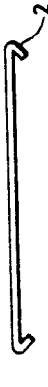
FIG. 2C shows the edges of the strip further bent 45° inwardly.
Figure 2D:
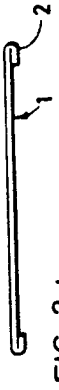
FIG. 2D shows the turned edges of the strip flattened onto the strip.

Two alternative strip edge enlargement profiles are shown in FIGS. 6 and 7. This form of enlargement is achieved, as shown in FIGS. 8 and 9, by hot or cold edge rolling a steel strip to deform the edges and thereby enlarge them. The strip is constrained between two vertically spaced rolls 30 while two laterally spaced rolls 31 bear on the small edge portions of the strip projecting from the sides of rolls 30. The edges 32 of rolls 30 may be rounded or otherwise profiled while the rolls 31 have central grooves 33 of a desired shape which receive the edges of the strip. The required force applied via the rolls 31 acts to deform or upset the edges of the strips to achieve enlargement thereof.

This alternative method of edge enlargement has the advantage that the shape of the enlargement can take many different forms whereas the shapes available from the edge folding process are limited. The edge-rolled shape may for example be such as to provide a form of controlled interface rupture of the fibres when the reinforced composite is stressed so that the characteristics of the composite can be positively controlled.

Following the edge deformation process, the strip is sheared as in the previous embodiments. The strip fed to the edge rolling arrangement may be taken from a storage coil having been slit from a wide strip and recoiled previously, or slit strips may be vertically separated as described above and fed into the required number of edge rolling arrangements.

The resulting fibre shown in FIG. 9A therefore has a plain rectangular section shank 34 and raised projections 35 of generally parabolic configuration extending from opposite faces of the fibre. The sides 36 of the fibre are plain and generally perpendicular to the opposite faces due to shearing operation.

The alternative edge profiles shown in FIGS. 10 to 13 are included in this specification to illustrate that the forms described above are merely exemplary.

The strip profiles shown in FIGS. 10 and 11 may be achieved by longitudinal rolling of the strip by means of suitably profiled rollers.

The edge profile of FIG. 12 is achieved by roll forming operations similar to those used in the first two embodiments. The roller profiles necessary to achieve this form will be self-evident.

The profile of FIG. 13 is achieved by rolling up the folded edge of the strip at stages *d* or *h* of the previous embodiments.

In general, the dimensions of the shank and the dimensions of the enlarged ends will be governed by a number of design factors, as well as the selection of the matrix material and the reinforcing fibres material. It is generally preferred that the fibre aspect ratio (that is, the ratio of fibre length to diameter or width) be no greater than 100, as greater aspect ratios are somewhat more difficult to handle. Normally, the shank will have a thickness of about 0.005 to about 0.03 inches, a width of about 0.01 to about 0.06 inches, and a length of at least 0.5 inches. Normally, the length will be no greater than about 3 inches, preferably no greater than about 2 inches.

The relationship between the dimensions of the enlarged ends and the dimensions of the shank are a significant feature of the present invention. When the enlarged end is formed by a folding operation, the enlarged end will generally have a thickness which is a multiple of the thickness of the shank, although an additional flattening step or the like could be performed if desired to change this relationship. Normally the folded enlarged end thickness will be about 2 – 4 times the thickness of the shank.

Greater flexibility of the enlarged end-shank ratio can be obtained with the method of edge deformation by edge rolling. To obtain the maximum energy-absorbing properties from a composition of a matrix such as concrete or cement and reinforcing discontinuous filaments of steel or the like, it is desired that the interfacial bond between the matrix material and the reinforcing fibre be ruptured just prior to the point where the fibres are subjected to a tensile stress which is in excess of their ultimate tensile strength. This stress, of course, depends upon the particular material of which the filaments are made, as well as the dimensions of the filament shank. The enlarged ends of the filament can be chosen of such size and design as to permit interfacial movement of the filament in the matrix just prior to filament rupture. This has the effect of permitting greater amounts of energy to be absorbed in the composite structure, as a sudden rupture of the filament without such interfacial movement is normally rapidly propagated throughout the composite structure. Composite reinforced structures utilizing the reinforcing filaments permitting the interfacial movement described above have particular application for uses where the structures are subjected to high impact loadings. For some such composite compositions, the ratio of enlarged end thickness to shank thickness may be as small as 1.5 or even lower, but normally such ratio will be about 2.

On the other hand, when the design considerations dictate that the fibres should rupture prior to significant interfacial slippage, the ratio of enlarged end thickness to shank thickness may be much higher, e.g., as high as 4 or 6, or even higher. Such higher thickness ratios are generally difficult to obtain by edge rolling, and the folding technique will generally be used.

The length of each enlarged end portion of the reinforcing fibre may vary as desired. Normally, for economical reasons the length of the enlarged portions will be chosen as small as possible. Bearing this in mind, therefore, the shank will normally be at least 70% of the length of the reinforcing fibre, preferably at least 80% and more preferably at least 90% of the reinforcing fibre length.

It will be appreciated that, because of the configuration of their enlarged ends, each of the reinforcing elements described herein lend themselves to easy handling as distinct from many of the prior art fibres which may have sharp ends and are thus prone to cause injury when handled.

The strip or even the individual fibres may be heat treated or chemically treated, using conventional treatment procedures prior to or after the rolling or shearing operation, depending upon the intended end use of the reinforcing elements.

In using reinforcing fibres embodying the invention to reinforce a castable material, the necessary fibre content of the required strength and enlarged end characteristics is experimentally or otherwise determined and the fibres admixed with the material prior to casting. Where the material is concrete or mortar, the quantity of fibres may be selected to be sufficient to inhibit the propagation of cracks in the reinforced composite.

As already mentioned, the enlargement of the ends of the filament or fibre in any one of the manners described serves to increase the locking effect between the ends of the fibres and the cast material, accordingly the reinforcing effect of the fibre should be increased by using up to all of the filament's available tensile strength. Table 1 dramatically illustrates the increase in the locking effect. The use of fibres embodying the invention may result in the achievement of equivalent physical tensile strength using a lower proportion of fibres than in the prior art thus decreasing the cost of a given strength or improved matrix strength for the same proportion of fibres than in the prior art.

The reinforcing effect of the end-enlarged fibres of the present invention is difficult to directly measure, due to a number of factors, including the random distribution of fibres in the matrix, possible fibre orientation in the matrix, test specimen size effects, and the like. The following pull-out tests illustrate the reinforcing effect obtained with the present invention.

In the pull-out or extraction tests reported in Table 1 below, 10 fibres were embedded in a 2.5:1 Portland cement mortar, with each fibre being at least ½ inch distance from the other fibres. The test specimen was wet cured for seven days at room temperature. Then the fibres were individually extracted from the test specimen, with the values reported in Table 1 being the average of the ten extractions (or breaks, as the case may be). The single fold enlarged ends were about 0.02 inches thick and about 0.05 inches long. The double fold ends were about 0.03 inches thick and about 0.06 inches long.

The average tensile strength of the fibre was 103,00 lbs/ins. The fibres were manufactured by shearing 0.010 inch strip into 0.030 inch wide fibres.

The dramatic increase in the locking effect introduced by the use of enlarged end fibres indicates that it may be necessary to produce fibres from high tensile steel in order to obtain the full benefit of the predicted increase in strength of cast materials incorporating such fibres. For certain high tensile steels, it may not be possible to use the edge folding technique but it is believed that the edge rolling method described will produce satisfactory high tensile fibres.

I claim:

1. Reinforcing fibers for castable matrix materials, each of said fibers comprising a shank portion of substantially uniform generally rectangular cross-sectional area, said shank having an average width of about 0.010 to about 0.06 inches and an average thickness of about 0.005 to about 0.03 inches, and raised projections extending from two opposite faces of the shank at each end of the fibers, each projection having a generally parabolic longitudinal cross-sectional elevation and a generally rectangular transverse cross-sectional elevation, the raised projections forming enlarged portions at each end of the shank of said fibers having cross-sectional areas at least about 1.5 times larger than the cross-sectional area of the shank, said fibers having an average length of about one-fourth to about three inches.

2. Reinforcing fibers for castable matrix materials, each of said fibers comprising a shank portion of generally rectangular cross-sectional area, said shank having an average width of about 0.010 to about 0.06 inches and an average thickness of about 0.005 to about 0.03 inches, and enlarged portions comprising raised projections extending from at least one face of the shank and at least near each end of the fiber, each projection having a generally parabolic profile when viewed in the longitudinal cross-sectional elevation and a generally rectangular transverse cross-sectional elevation, said enlarged portions having cross-sectional areas at least about 1.5 times larger than the cross-sectional area of the shank, said fibers having an average length of about one-fourth to about three inches.

TABLE 1

PULL-OUT TESTS — COMPARISON OF PLAIN FIBERS and FIBERS WITH END ENLARGEMENT

| Fiber | Embedment Depth | Nominal cross-section dimensions | Average bond strength lb/ins2. | % increase | Average wire stress at pull-out or break lb/ins2. | % increase |
|---|---|---|---|---|---|---|
| Plain Rectangular | 0.5" | 0.030"×0.010" | 397 | — | 52,500* | |
| Rectangular with single fold end | 0.375" | 0.030"×0.010" | 699 | 76% | 70,200* | 33.5% |
| Rectangular with double fold end | 0.375" | 0.030"×0.010" | 999 | 152% | 101,500** | 93% |

*All fibers pulled out of the mortar

**Eight fibers broke off while two fibers pull out of the mortar.

3. Reinforcing fibers for castable matrix materials, each of said fibers comprising a shank portion of generally rectangular cross-sectional area, said shank having an average width of about 0.010 to about 0.06 inches and an average thickness of about 0.005 to about 0.03 inches, and enlarged portions comprising raised projections extending from at least one face of the shank and at least near each end of the fiber, each projection having a generally hyperbolic profile when viewed in the longitudinal cross-sectional elevation and a generally rectangular transverse cross-sectional elevation, said enlarged portions having cross-sectional areas at least about 1.5 times larger than the cross-sectional area of the shank, said fibers having an average length of about one-fourth to about three inches.

4. Reinforcing fibers for castable matrix materials, each of said fibers comprising a shank portion of substantially uniform generally rectangular cross-sectional area, said shank having an average width of about 0.010 to about 0.06 inches and an average thickness of about 0.005 to about 0.03 inches, and enlarged portions at each end of the shank, said fibers having an average length of about one-fourth to about three inches, said enlarged portions comprising end portions of the fiber folded upon the fiber, with said folded end portions extending generally parallel and substantially contiguous with the fiber, wherein the thickness of each folded portion is from two to four times the thickness of the fiber.

* * * * *